United States Patent [19]

Reed

[11] 4,019,466

[45] Apr. 26, 1977

[54] APPARATUS FOR RADIANT HEAT TRANSFER

[75] Inventor: Robert D. Reed, Tulsa, Okla.

[73] Assignee: John Zink Company, Tulsa, Okla.

[22] Filed: Nov. 3, 1975

[21] Appl. No.: 627,848

[52] U.S. Cl. ..... 122/367 R; 110/98 R; 122/356

[51] Int. Cl.[2] ..... F23M 9/00

[58] Field of Search ..... 110/97 R, 98 R, 98 A; 122/356, 367 R, 421

[56] References Cited

UNITED STATES PATENTS

| | | | |
|---|---|---|---|
| 529,997 | 11/1894 | Baker | 110/98 |
| 1,715,614 | 6/1929 | Mills | 110/98 |
| 1,812,198 | 6/1931 | Clayton | 122/367 |
| 1,919,192 | 7/1933 | Behr | 122/421 |
| 2,151,386 | 3/1939 | DeFlorez | 122/367 X |

*Primary Examiner*—Kenneth W. Sprague
*Attorney, Agent, or Firm*—Head, Johnson & Chafin

[57] ABSTRACT

Apparatus for improved recovery of heat from combustion gases in the convection section of a furnace by improved radiant heat transfer. Thin strips of selected metals are arrayed and supported on the fluid carrying pipes in the furnace, in such a way that interference to the vertical flow of combustion gases is held to a minimum. The metal strips are heated by flow parallel to their surfaces of the combustion gases. Heat is radiated from the metal strips to the pipes with a consequent increase of heat transfer to the fluid within the pipes.

7 Claims, 5 Drawing Figures

APPARATUS FOR RADIANT HEAT TRANSFER

BACKGROUND OF THE INVENTION

1. Field of the Invention

This invention lies in the field of heat transfer apparatus. More particularly it concerns improving the heat transfer in a convection section of a furnace, by the addition of metal strips which are heated by convection from the flowing combustion gases, and which radiate heat to the pipes carrying the fluid to be heated in the furnace.

2. Description of the Prior Art

In the process industries, where fluid raw materials are converted into more useful or more valuable products through application of heat energy in well known manners to the raw materials, structures which are called "heaters" are employed.

A heater is composed of a furnace or combustion volume; burners to inject fuel into the furnace, in calculated manners, for provision of a supply of heat energy, such as may be required, and a sinuous tubular passage through the burner-heated areas. The tubular passage is entirely within the heated volume and spaced from the furnace structure.

The tubular passage is for closed transport of the fluid to be heated through the furnace areas where, due to burner-produced heat energy, the fluid, as it flows through the tubular passage, receives heat energy through a process which is typically identified as heat transfer — that is, the heat energy which is supplied to the furnace areas passes through the wall of the tubular passage to enter the flowing fluid. Such heat-energy transfer results in increase in the state of molecular motion with the flowing fluid, and since absolute temperature varies as the square of the average molecular motion, the temperature of the flowing fluid is caused to rise to a preferred or required level.

In such processing action, it is not possible to recover all of the burner-produced heat for transfer to the flowing fluid, since residual combustion gases, vented to atmosphere after all possible heat recovery, are at temperature which is hundreds of degrees above the temperature of fuel and air supplied for burning. This residual gas temperature (stack temperature) is useful in that, because of it, the stack or chimney can produce 'draft' or less-than-atmospheric pressure inside the furnace. The less-than-atmospheric pressure inside the furnace causes a required quantity of air to be drawn into the furnace for mixture with the fuel to permit fuel burning or combustion to occur to a required degree. However, the heating of stack gases results in heat-energy loss such that efficiency of heat recovery (thermal efficiency) seldom exceeds 82% and is typically in the order of 75% or less.

Prior to the fuel/energy crisis, and when supplies of fuel were both plentiful and cheap, there was small concern if the thermal efficiency of a process heater was slightly greater than 70%, and many furnace/heater installations were designed for 70%+ efficiency (not 80%+). These, or many of these, are still in operation to the great distress of their operators because of excessive fuel requirement, when fuel cost has increased many times, and is no longer plentiful. For the average heater, fuel costs per year have increased by hundreds of thousands of dollars, and this amounts to precious fuel wastage.

Design factors of the furnace or heater determine the thermal efficiency to be expected, and 1975 design practice dictates stack temperature at 400° F. rather than 800° F. upward, for added conservation of 11% of fuel burned for a required service, or more. But this is for heaters now being built. For existing heaters there is reason to improve thermal efficiency, as is obvious, but at very great expense for alteration, and at the expense of serious loss of product because the heater cannot be operated during the time the heater is being modified which may take up to 7 days.

In the art of process heater design, and to provide reasonable nomenclature, the heater, per se, is considered as three separate sections. These are the "radiant" section, the "convection" section, and the "stack" section.

Nomenclature for the three sections is based on the service performed by separate sections. Heat transfer is either through radiant effects; through convective effects or both, while the stack vents combustion gases to atmosphere while providing draft for induction of combustion-supporting air, or maintenance of less-than-atmospheric pressure within the heater structure. Preponderance of heat transferred is in the radiant section (typically 80% of total heat transferred) with smaller quantities of heat (typically 20%) transferred in the convection section. This heat transfer relative state is due to two factors. The first is that, in reference to relative heat transfer per square foot of tubular heat transfer surface, the higher combustion chamber temperature, plus effects of radiant heat transfer, plus certain convection effect causes greatest heat transfer to occur in the "radiant" section area. Even if the "radiant" and "convection" heat transfer surface areas should be equal, a significant preponderance of heat transfer would occur in the "radiant" areas. The "radiant" areas are defined as the areas which can "see" the burner flames and radiant combustion chamber surfaces, where these surfaces are typically formed of refractory material. The "convection" areas are defined as areas of tubular heat transfer surfaces which cannot see the burner flames or radiant combustion chamber surfaces. In all areas, there is some heat transfer by both mechanisms, according to the relative emissivities and temperatures of the radiant heat sources.

Emissivity denotes ability to emit radiation of energy as heat. The emissivity of heated gases (due to the presence of binary molecules such as $CO_2$, $H_2O$ and $SO_2$—$SO_3$) is quite small and is typically 0.05, while the emissivity of refractory surfaces can be considered, typically, as 0.80 or greater (16 times greater or more). Radiant heat is as infra-red emission which is predominantly absorbed by, but partially reflected from the tubular heat transfer surfaces, according to the absorptivity of the surfaces. Relative absorptivity of surfaces is according to Kirchoff's Law which teaches that ability to emit is equal to ability to absorb. Radiant heat transfer between bodies is according to the Stefan-Boltzmann Law (Perry's Chemical Engineers' Handbood).

Convective heat transfer is due to flow of fluids, where the quantity of heat energy transferred is proportional to flow mass-velocity and temperature difference, and in the case of process heaters, the fluid is heated combustion gases from which a significant portion of combustion heat has been removed.

Thus, the convection section becomes a part of process heaters as means for final recovery of combustion heat (an 'economizer') as the combustion gases are compelled to give up heat energy as they move toward final venting to atmosphere, and total loss of residual heat energy, but in many existing process heaters, the convection section is far from adequate for suitable heat recovery. As has been pointed out, very expensive and time-consuming means for added heat recovery are available for these heaters. But in many cases, because of either high cost or because of lost process time, there is great reluctance to apply these means to heaters, and as a result, the heater operation is both wasteful of fuel and more expensive.

Earlier delineation of heater nomenclature as the "radiant section" as the "convection section" is convenient but not accurate. Radiation of heat energy between two adjacent bodies immediately begins to occur when the temperature of one body exceeds the temperature of the adjacent body. Heat energy transferred is related to the fourth-powers of the absolute temperatures; it is also proportional to emissivity and absorptivity.

SUMMARY OF THE INVENTION

As has been discussed, radiant heat transfer is most effective, and any improvement in convected heat transfer, without the addition of convective heat transfer area, is best realized through addition of radiant heat transfer to convection areas such as they may be. Combustion gases, which contain binary gases, have the very low radiant factor of o.05 typically, so a form of enhanced radiant effect is to be had through addition of material which is combustion gas-heated and has far more emissive surface to convection areas. The emissivity of steels ranges from 0.79 to 0.94 (Process Heat Transfer, Kern, McGraw-Hill). Emissivity of the stainless-steels, which are required for heat resistance, average at 0.80. Thus, through the addition of steel surfaces to convection areas, radiant heat transfer is increased in the ratio of 0.80/0.05 to result in increased heat transfer in these areas, for greater total heat recovery and greater thermal efficiency in heater operation.

It is a primary object of this invention to provide an apparatus which can be installed in a furnace in the convection section, at minimum cost, and minimum shut down time, whereby the heat transfer efficiency from the combustion gases venting to the stack can be improved.

This and other objects are realized and the limitations of the prior art are overcome in this invention by providing a plurality of metal strips of the proper composition to withstand temperature, etc. These strips are loosely hung on and supported by the horizontal pipes which are in the furance, and through which flow the fluids to be heated by the furnace.

The strips are supported on the pipes and thread diagonally between the pipes. They are attached to horizontal strips which rest on the top row of the pipes. The strips are maintained with their surfaces vertical, so as to minimize the reduction in cross sectional area of the space through which the combustion gases flow. A plurality of such sets of strips are placed on the pipes. These are spaced from each other in equal, or in random, spacings, as desired, and in a number such that the more the better, provided the presence of additional sets of strips does not increase the flow resistance to the point where additional stack height or other means is required to provide the input of sufficient combustion air for the furnace.

BRIEF DESCRIPTION OF THE DRAWINGS

These and other objects and advantages of this invention and a better understanding of the principles and details of the invention would be evident from the following description taken in conjunction with the appended drawings in which.

DESCRIPTION OF THE PREFERRED EMBODIMENT

Figure 1:
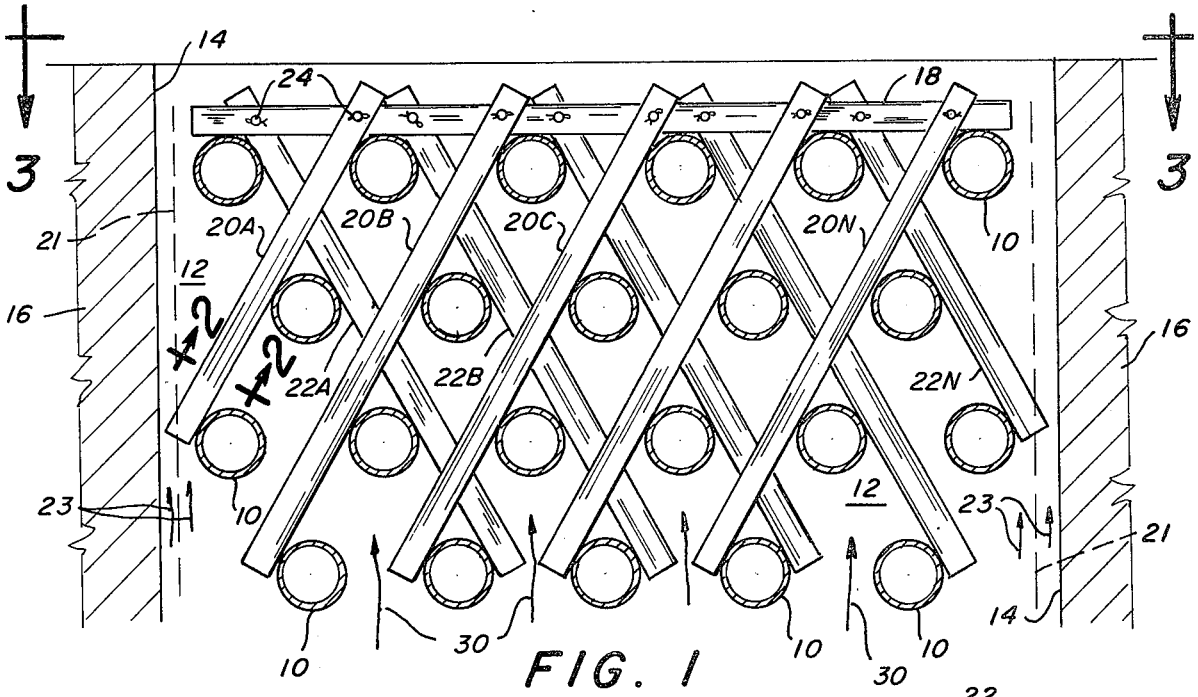
FIG. 1 illustrates an elevation view of the convection section of a furnace showing the heating pipes in cross section, and the presence of the apparatus of this invention.
Figure 4:
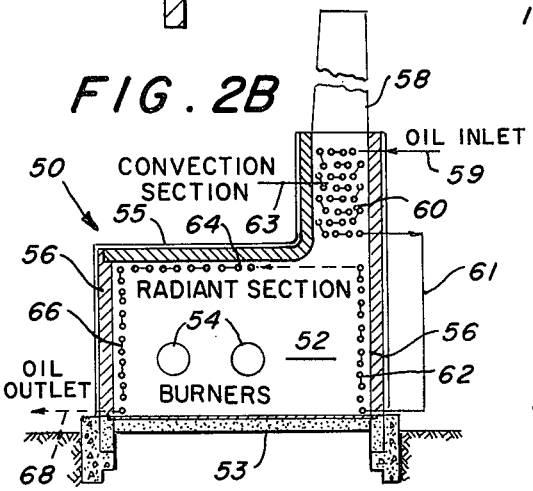
FIG. 4 PRIOR ART
FIG. 4 is a sketch of a prior art furnace showing in a general way the relative parts of the furnace in which the principle heat transfer is by radiation and by convection.

Referring now to the drawings and in particular to FIG. 1 there is shown a vertical cross section through the convection section of a furnace, in which a plurality of pipes 10 are shown in spaced position in a series of horizontal planes. Each of the pipes is connected at its ends to adjacent pipes, so as to form a continuous, sinuous conduit for the passage of a fluid to be heated in the furnace. These pipes are placed within a portion of the furnace comprising walls 16 of suitable material, and lined 14 with ceramic as necessary, and as is well known in the art. As will be shown in FIG. 4, the hot products of combustion flow in accordance with the arrows 30 vertically through and in contact with the surfaces of the pipes 10, and up to a stack which is not shown in FIG. 1 but is indicated in FIG. 4.

As previously discussed, the purpose of this invention is to increase the heat transfer from the combustion gases 30, to the pipes 10 and to the fluid within the pipes. The heat transfer from the gases to the pipes is mainly by convection, and involves actual contact with the surface of the pipe, since the ability of the cooled combustion gases to radiate energy is minimal.

A plurality of thin planar strips 20 of metal are supported by a strip 18 which rests with its plane vertical, on top of the top row of pipes 10.

Supported from the top strip 18 are a plurality of strips 20A, 20B, 20C . . . 20N which are attached loosely to one surface of the strip 18, and hang at an angle to the vertical, resting on the pipes as indicated. There is a second set of strips 22A, 22B . . . 22N which are supported from the strip 18 at its opposite surface, and which hang at an opposite angle, and are supported by the pipes as indicated in FIG. 1. Of course, the particular arrangement and spacing and angles of the strips as they are supported from the strip 18 will depend materially on th particular arrangement of pipes and their spacing in rows and columns.

In general, however, a planar arrangment of metal surfaces is desired, with as much surface area as possible, such that with the vertically flowing combustion gases heat will be transferred by convection from the gases to the strips to raise their temperature, and hopefully raise their temperature higher than the temperature of the pipes, so that net heat will be radiated from the strips to the pipes.

Referring now to FIG. 4, which is a prior art illustration, there is shown, as a typical example, a furnace 50 having a radiant section comprising a housing of walls 56, floors 53 and ceiling 55. There are a plurality of burners 54 injecting combustible fluid into the furnace for its combustion therein, and to provide a flow of air to the burners for the combustion. The air is inducted into the burning zone due to the draft created by the flow of hot products of combustion up through the convection section 63 and to the stack 58, to the atmosphere.

The furnace is provided for the purpose of heating some liquid, such as crude oil, in a refinery, for example. The oil flows into the furnace through pipe 59 and through a plurality of sections which are interconnected indicated by the numeral 60. These are placed in the upper portion of the heater in an area called the convection section, because pipes in that area are not in direct view of the luminous radiating surfaces of the furnace walls 56. The pipes 60 are in the coolest portion of the system, and are connected through a pipe 61 to a series of pipes 62, 64, 66, and to an outlet 68. The pipes 62, 64, 66 are mounted in planes which are parallel to but separated from the walls and roof of the furnace. The purpose of this is to provide for free flow of flame and combustion gases around the pipes so that the gases might transfer heat by convection to the walls and the pipes, and also so that the pipes will receive heat from the radiating walls of the furnace.

It is the pipe sections 60 in the convection section of the heater that can benefit most by the improvement of this invention, and this is the area of the heater to which this invention is directed.

Choice of metal for the strips is based upon the consideration of the temperature to be expected and the emissivity characteristic of the metal to be chosen as the radiant material. The character of the metal must remain substantially constant with increased life to provide sufficient duration of operation to make the installation practical. Stainless steel is an ideal material.

Figure 3:
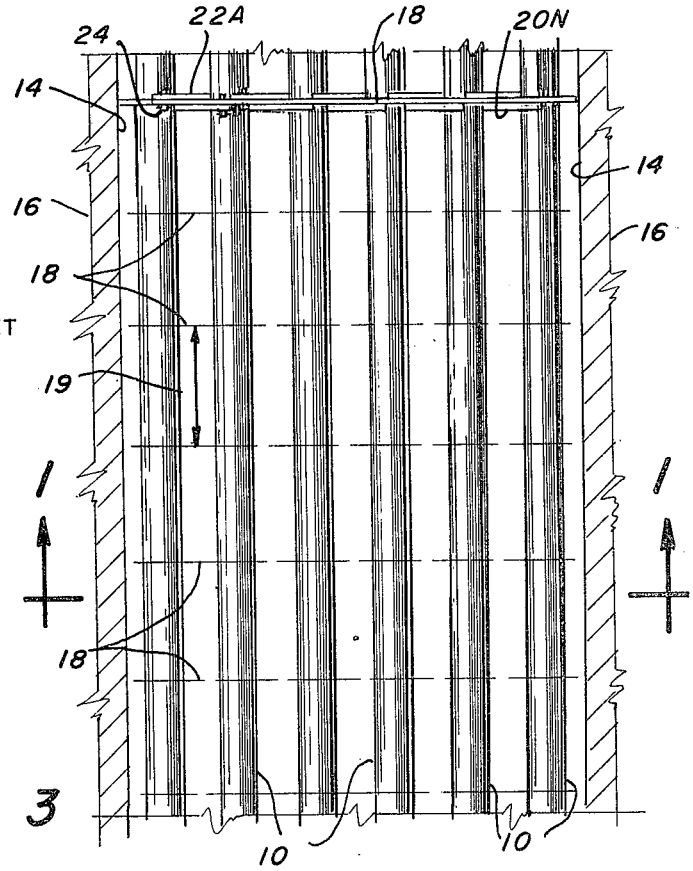
FIG. 3 is a plan view of the apparatus taken along the plane 3—3 of FIG. 1.

FIG. 3 illustrates a plan view of the pipes 10, and the plurality of strips 18 spaced along the length of the pipes.

Figure 2A:
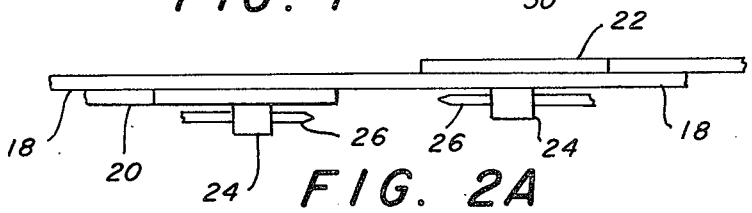
FIG. 2A illustrates a plan view of a portion of the apparatus which is added to the furnace.

As shown in FIG. 2A the strips 20, 22 can be loosely attached to the horizontal strip 18 by pins as shown, or by screws and nuts, by cotter pins and the like.

Figure 2B:
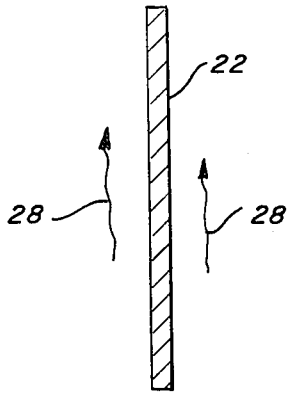
FIG. 2B illustrates a cross section of one strip taken along the plane 2—3 of FIG. 1.

FIG. 2B illustrated how the hot combustion gases 28 flowing parallel to the surfaces of the strip 22 will transfer heat by convection to the strips, thus raising their temperatures and permitting them to radiate heat to the pipes.

While the strips are shown in this description as diagonally hanging strips, with vertical plane, they may be configured in other ways, particularly if the pipes are arranged in another order.

Also thin sheets of metal 21 may be hung along the walls 14, spaced from the walls so as to permit the flow of combustion gases 23 on both sides of the sheet.

While the invention has been described with a certain degree of particularity it is manifest that many changes may be made in the details of construction and the arrangement of components. It is understood that the invention is not to be limited to the specific embodiments set forth herein by way of exemplifying the invention, but the invention is to be limited only by the scope of the attached claim or claims, including the full range of equivalency to which each element or step thereof is entitled.

What is claimed is:

1. In a process heater including; a furnace, a convection section and a stack for the flow of combustion gases, a plurality of parallel pipe sections in series connection, for the passage of a fluid through said pipes to receive heat from said heater, said pipe sections, arranged in the convection section in a plurality of vertically spaced horizontal rows defining inclined spacings from top to bottom; the improvement in means to improve the heat transfer from the combustion gases to said pipes comprising:

a plurality of thin wide straight metal strips resting within said inclined spacings against said pipes such that said wide dimension is parallel to the flow of said gases and said thin dimension is angularly transverse to said flow.

2. In the apparatus as in claim 1 the further improvement comprising the assembly of;

a. a first horizontal thin wide straight strip resting on the top row of said pipes with its wide dimension parallel to said flow of gases;

b. said plurality of strips attached at their top ends to said horizontal strip.

3. The apparatus as in claim 2 including a second plurality of strips attached to a second horizontal strip, with said second strips hanging within said inclined spacings at an opposite angle to said first strips.

4. The apparatus as in claim 2 in which said strips are attached to said horizontal strips by pins.

5. The apparatus as in claim 1 in which the ratio of width to thickness of said strips is in the range 10 to 1, to 25 to 1.

6. The apparatus as in claim 1 in which said strips extend at least throughout the vertical extent of said pipes.

7. The apparatus as in claim 1 which said strips are made of stainless steel having an emissivity factor of at least 0.79.

* * * * *